US006053014A

United States Patent [19]

Cooper

[11] Patent Number: 6,053,014

[45] Date of Patent: Apr. 25, 2000

[54] KNITTED ARM WARMER

[76] Inventor: Shane Cooper, 1725 5th St. Ct. NW., Hickory, N.C. 28601

[21] Appl. No.: 09/102,126

[22] Filed: Jun. 22, 1998

Related U.S. Application Data

[63] Continuation-in-part of application No. 08/915,705, Aug. 21, 1997, abandoned.

[51] Int. Cl.[7] ..... D04B 9/44; A41D 13/08

[52] U.S. Cl. ..... 66/172 E; 66/172 R; 2/16

[58] Field of Search ..... 66/169 R, 170, 66/171, 172 R, 173, 172 E, 174, 176, 178 R, 183, 202; 2/16, 59, 125, 126, 170, 162, 167; 602/3, 62

[56] References Cited

U.S. PATENT DOCUMENTS

| | | | |
|---|---|---|---|
| 1,254,722 | 1/1918 | Oakes | 66/171 |
| 4,330,887 | 5/1982 | White | 2/16 |
| 4,967,419 | 11/1990 | Elliott | 2/16 |
| 5,319,807 | 6/1994 | Brier | 2/239 |
| 5,357,633 | 10/1994 | Rael | 2/16 |
| 5,638,546 | 6/1997 | Vita | 2/16 |
| 5,734,992 | 4/1998 | Ross | 2/161.7 |
| 5,878,435 | 3/1999 | Kast et al. | 2/16 |

FOREIGN PATENT DOCUMENTS

| | | | |
|---|---|---|---|
| 2237975 | 5/1991 | United Kingdom | 2/16 |

*Primary Examiner*—Danny Worrell
*Attorney, Agent, or Firm*—Charles Y. Lackey; Kilpatrick Stockton LLP

[57] ABSTRACT

An arm warmer is formed from a circularly knitted tubular fabric member made up of a wrist cuff, a tapered arm portion, and a binder portion. The fabric member is knitted with nylon, nylon covered spandex, and wicking yarns of various configurations for the wrist cuff, the arm portion, and the binder portion, to form an arm encompassing sleeve that can be maintained on the arm of the wearer that will provide warmth and increase blood circulation at the commencement of use, and which can be rolled down the arm and maintained thereon in a rolled condition when a sufficient body temperature has been reached.

17 Claims, 5 Drawing Sheets

KNITTED ARM WARMER

This is a continuation-in-part application based on pending patent application Ser. No. 08/915,705, filed Aug. 21, 1997 now abandoned.

FIELD OF THE INVENTION

The present invention relates generally to arm coverings and more particularly to a bicyclist knitted arm warmer providing warmth and increased circulation at the commencement of use which can be rolled down to expose the arm when a sufficient body temperature has been reached.

BACKGROUND OF THE INVENTION

There are numerous prior art patents disclosing various types of sleeve-like items which are specifically designed for a wide range of different purposes. Representative of these include U.S. Pat. No. 4,006,495 (Jones); U.S. Pat. No. 3,837,007 (Giresc); U.S. Pat. No. 2,326,422 (Weisberger); and U.S. Pat. No. 1,296,430 (Riley). Though the prior art shows a large number of sleeve-like items designed for many purposes, none of them specifically deals with a warm-up sleeve to be worn by a bicyclist, and none employ a securing technique capable of effectively keeping such an item in place on the arm of the wearer while he or she is engaged in bicycling activity.

Bicyclist arm warmers in use today include tubular members that have ends rimmed with or attached to rubber bands that grip the upper and lower arm of the wearer. For the most part, these arm warmers are formed from flat fabric that is seamed together to complete the tubular member. The yarn used to form the fabric is typically rubber or a combination of rubber and nylon yarn.

The incorporation of an elastic band in the upper end of such an arm warmer is designed to hold the upper edge of the item snugly about the arm of the wearer. In many instances, however, this securing technique does not retain the sleeve in place on the arm of the wearer during physical activity and thus, other features are required in order to ensure that it stays in place.

Game or sport associated accessories of many varieties are developed to reflect team colors or team logos so that team members are readily identifiable when they wear or use such accessories. Bicyclists wear numbers and colors of many varieties on shirts, helmets or other accessories. There has yet to be fully developed and totally received a common element or accessory for reflecting such identification in bicycling circles.

It is, therefore, to the development of a functional, superior fitting, and easily adjustable bicyclist's sleeve and the identifying capabilities that such a sleeve will provide that the present invention is directed.

SUMMARY OF THE INVENTION

The present invention is a knitted arm warmer formed of a tubular and circularly knitted fabric which includes a wrist cuff, a tapered arm portion, and a binder portion, the binder portion extending slightly above the bicep of the arm of the wearer to hold the member securely in place. The tapered arm portion is continuously and circularly knitted with the diameter of the tubular member during this portion being increased gradually by the use of graduated stitches on the knitting machine. The wrist cuff is of a conventional welt construction having two fabric layers joined at the make up yarn and folded upon itself like formed welts on ladies fashion hosiery products. The wrist cuff is formed in a rib knitted construction using nylon and spandex covered nylon yarns in a 1×1 or alternating plain knit and tuck knit construction. The binder portion is of a plain knit construction with two dissimilar yarns in every course. The tapered arm portion has a wicking yarn such as hollow core wicking polyester yarn plaited to the inside of the tubular member and next to the skin of the wearer and a nylon covered spandex yarn plaited to the outside of the tubular member. The arm portion is knitted with graduated stitches at selective locations to gradually increase its diameter until it joins the formation of the binder member. The binder member utilizes spandex, nylon, and polyester yarns and is knit so that the band rolls back on itself forming a comfortable, yet secure band, which holds the upper end of the garment in place.

The invention also includes a method for forming the bicyclist's sleeve which includes circularly and integrally knitting the wrist cuff, the tapered arm portion, and the binder portion in a continuous operation. The arm warmer and the method for producing the arm warmer are also directed to the use of multi-colored yarns for providing a pre-selected decorative design or effect in the wrist cuff and in the tapered arm portion. The invention is soon to be marked to the bicyclist community under the trademark armskin.

Thus, there has been outlined, rather broadly, the more important features of the invention in order that the detailed description that follows may be better understood and in order that the present contribution to the art may be better appreciated. There are, obviously, additional features of the invention that will be described hereinafter and which will form the subject matter of the claims appended hereto. In this respect, before explaining several embodiments of the invention in detail, it is to be understood that the invention is not limited in its application to the details and construction and to the arrangement of the components set forth in the following description or illustrated in the drawings. The invention is capable of other embodiments and of being practiced and carried out in various ways.

It is also to be understood that the phraseology and terminology herein are for the purposes of description and should not be regarded as limiting in any respect. Those skilled in the art will appreciate the concepts upon which this disclosure is based and that it may readily be utilized as the basis for designating other structures, methods and systems for carrying out the several purposes of this development. It is important that the claims be regarded as including such equivalent constructions insofar as they do not depart from the spirit and scope of the present invention.

So that the manner in which the above-recited features, advantages and objects of the invention, as well as others which will become more apparent, are obtained and can be understood in detail, a more particular description of the invention briefly summarized above may be had by reference to the embodiment thereof which is illustrated in the appended drawings, which drawings form a part of the specification and wherein like characters of reference designate like parts throughout the several views. It is to be noted, however, that the appended drawings illustrate only preferred and alternative embodiments of the invention and are, therefore, not to be considered limiting of its scope, as the invention may admit to additional equally effective embodiments.

DETAILED DESCRIPTION OF THE DISCLOSURE

Figure 1:
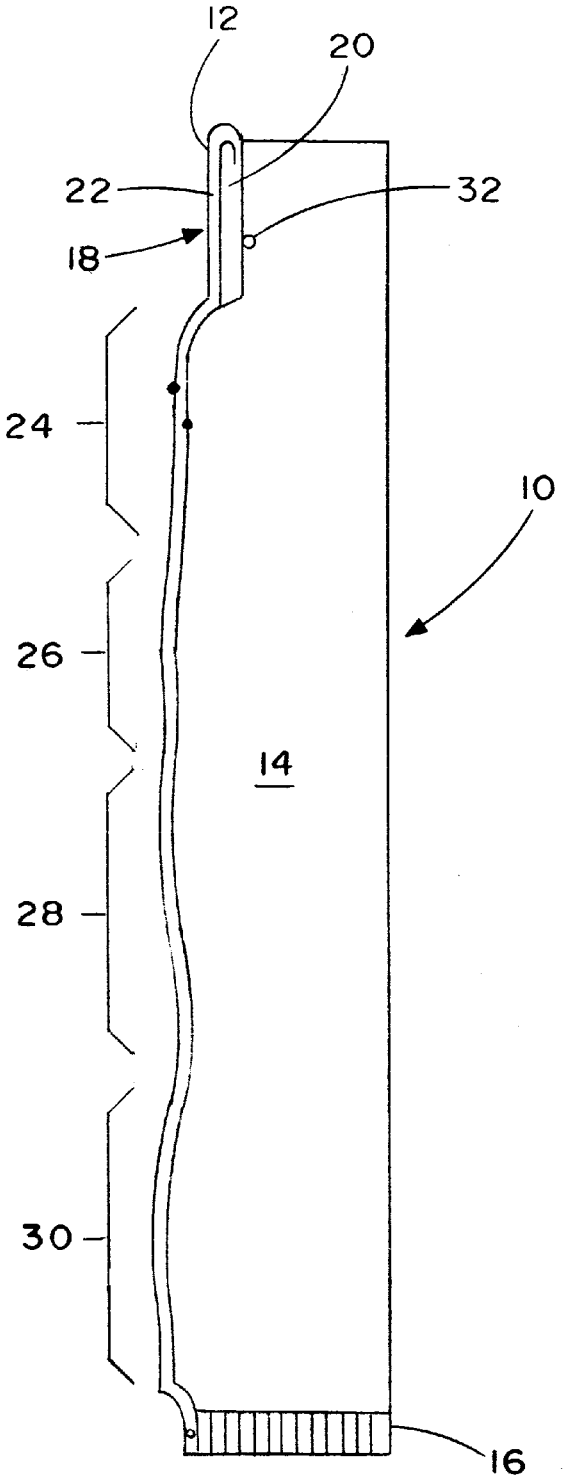
FIG. 1 is a side elevational view of a flatly folded tubular member comprising the present invention.

The primary embodiment of the bicyclist sleeve is shown in FIG. 1 and includes a circularly knitted tubular fabric member generally designated as 10 made up of a wrist cuff 12, a tapered arm portion 14 and a binder portion 16. The arm portion is tapered and extends from wrist cuff 12 with a diameter equal to the wrist cuff diameter which increases to a diameter substantially equal to the binder portion diameter when arm portion 14 joins binder portion 16.

Tubular fabric member 10 is manufactured on a small diameter knitting machine similar to those used in manufacturing ladies fashion hosiery with the knitting process being a continuous rotary knitting operation of the machine without reciprocation or other variations that depart from continuous circular knitting. In the manufacturing operation, the garment is commenced at the wrist cuff portion wherein a make-up yarn is used to initiate knitting and thereafter a welt shown generally as 18 is formed which has an inner fabric layer 20 and an outer fabric layer 22. Knitting continues from the outer fabric layer 22 of the welt 18 downwardly into tapered arm portion 14 which, in preferred form, consists of four unique sections 24 as graduation is increased. After section 30 is completed, binder portion 16 is knit utilizing polyester and nylon covered spandex yarn to produce a tubular fabric member length of from about 16 to 34 courses which functions to encompass the bicep of the wearer and roll back on itself to nest in the natural crevice of a wearer's arm where the shoulder joins the bicep and thereby maintain the tubular member on the arm of the wearer. The rollback 25 of tubular fabric member 10 forms a secure, efficient and comfortable means for holding the arm warmer in the appropriate location on the arm of the wearer.

Yarns used in manufacturing the arm warmer comprising the present invention may vary to some extent in accordance with the desire of the user, however, yarns to achieve desired results include a range of 60 to 80 denier 2 filament flat nylon yarn for the make-up and welt construction included in wrist cuff 12, nylon and nylon covered spandex in a 1×1 rib knit construction in inside layer 20 of welt 18 commencing at transition point 32 at inside layer 20 on and around to outside layer 22 until reaching section 24 of arm portion 14.

In arm portion 14 of the arm warmer, flat knit yarns such as DuPont Thermastat hollow core wicking polyester yarn and nylon covered spandex yarn are used with the wicking polyester plaited to the inside or first layer 20 lying next to the skin of the wearer and the nylon covered spandex plaited to the other or outer side.

Section 24 of arm portion 14 ranges from about 60 to 100 courses, depending on the size of the garment, and section 26 of arm portion 14 runs from about 90 courses to about 135 courses, again depending upon the size of the garment desired. Section 28 of arm portion 14 runs from about 135 courses to about 150 courses, depending upon the size desired. The final section 30 runs from about 140 courses to 170 courses, again depending upon size.

Figure 2:
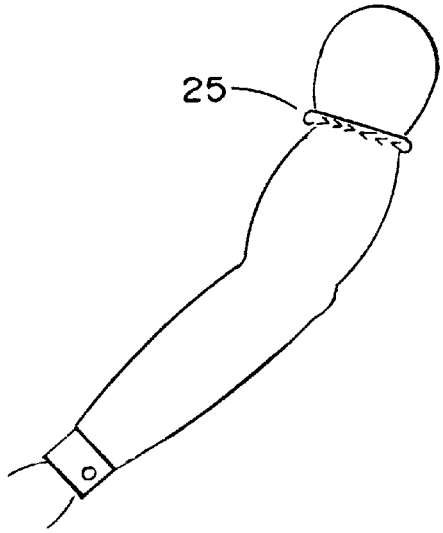
FIG. 2 is a fragmentary side elevational view of the arm warmer comprising the present invention covering the arm of a wearer.

Changes of stitch sizes in sections 24, 26, 28 and 30 are done on circular knitting machines through the knitting process of graduation, whereby the stitches are selectively lengthened to provide a looser and thus larger diameter tubular knit member, thus conforming to the normal shape of the limb which is encompassed by the garment constructed. FIG. 2 shows the taper of arm portion 14 accomplished by graduation and includes establishing differing diameters for sections 24, 26, 28 and 30.

Figure 3:
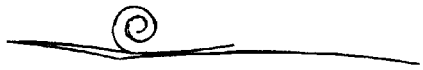
FIG. 3 is a fragmentary isolated view of the binder portion and connected arm portion of the present invention as it engages the arm of a wearer.
Figure 4:
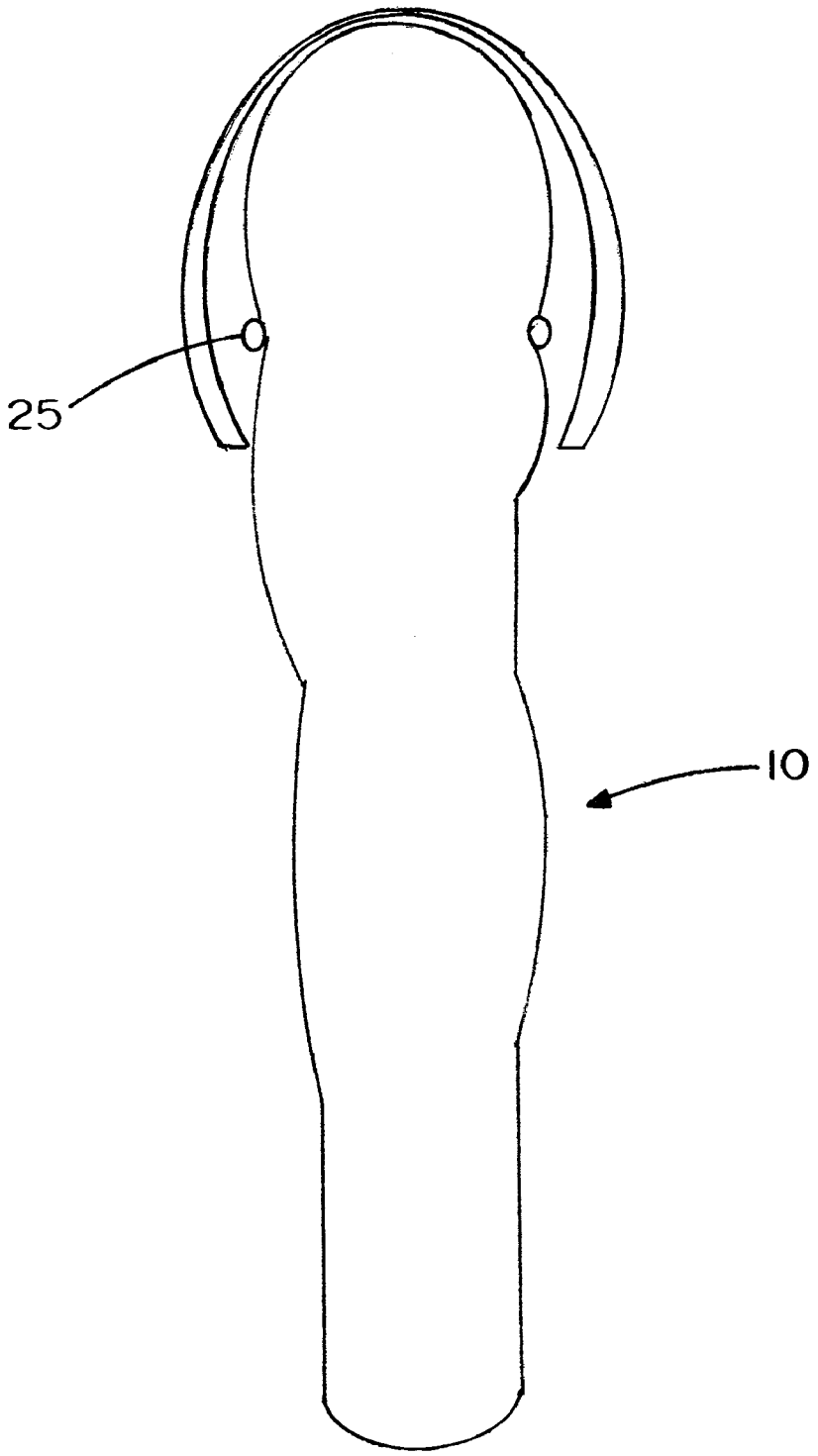
FIG. 4 is a fragmentary isolated schematic view of the arm warmer comprising the present invention in a rolled down condition on the arm of a wearer.
Figure 5:
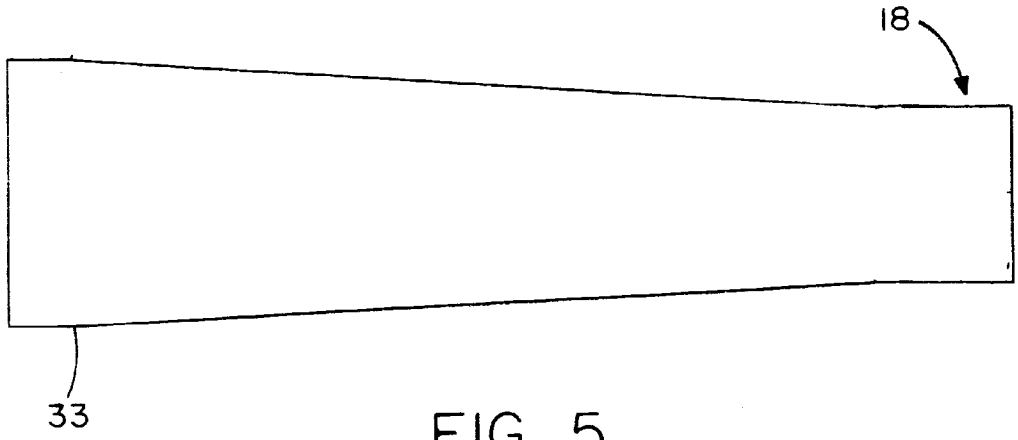
FIG. 5 is a schematic diagram of the arm warmer showing the binder member in an unrolled condition.
Figure 6:
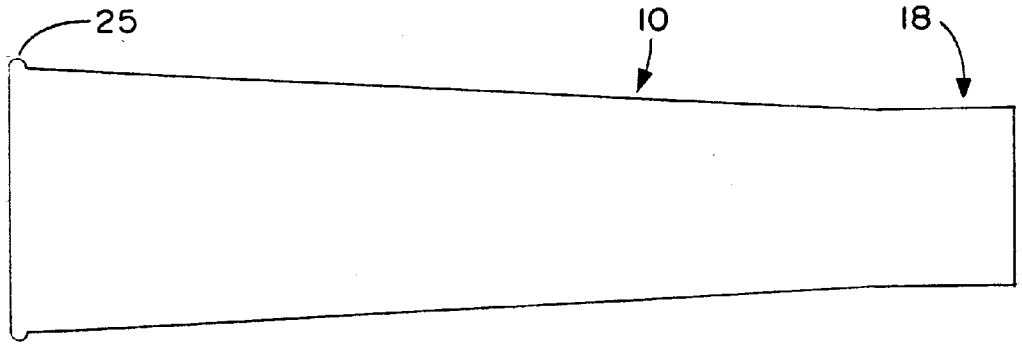
FIG. 6 is a schematic diagram of the arm warmer with the binder in a rolled condition.
Figure 7:
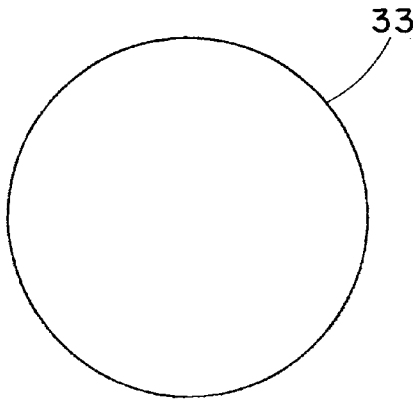
FIG. 7 is a schematic and elevational view of the binder member in an unrolled condition.
Figure 8:
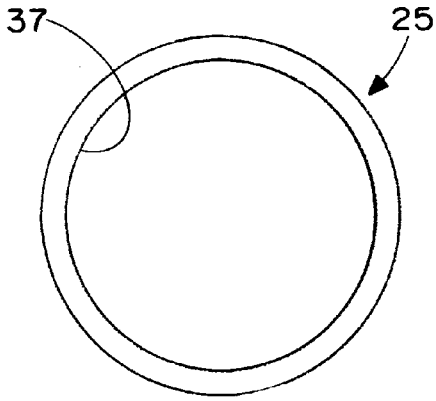
FIG. 8 is a schematic and elevational view of the binder member in a rolled condition.
Figure 9:
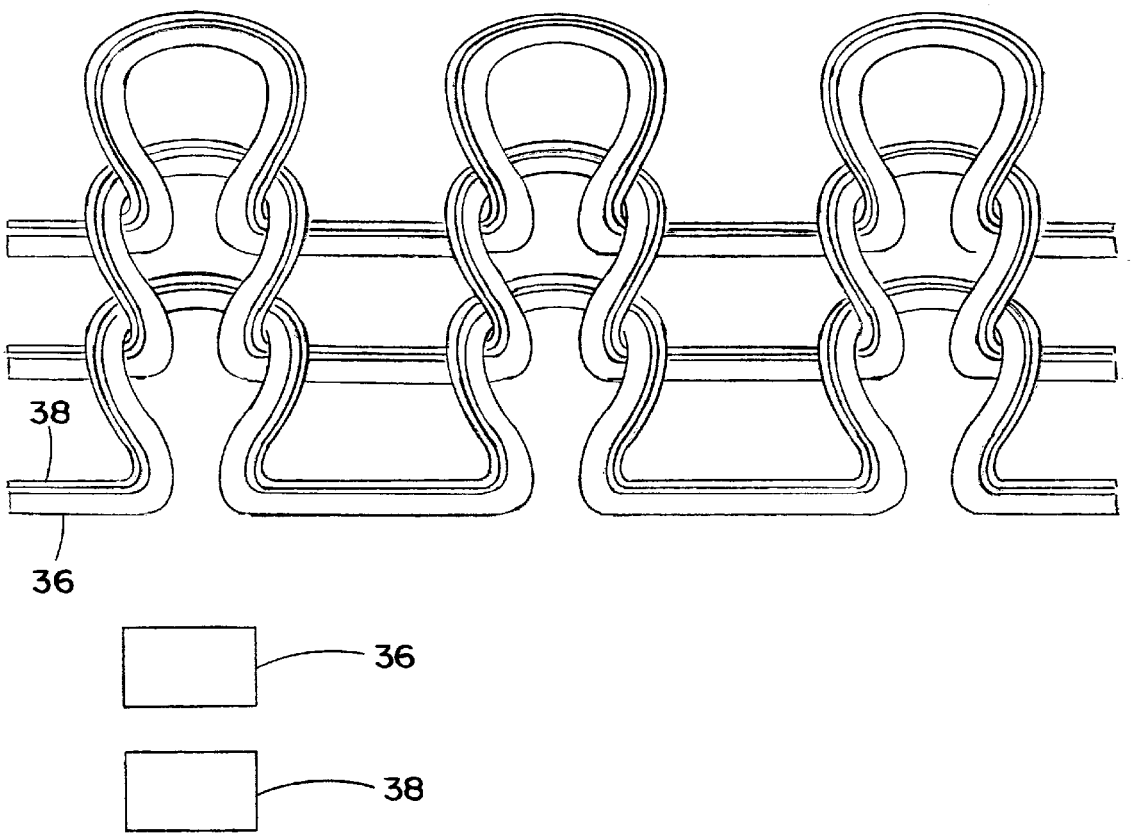
FIG. 9 is a partial fragmentary enlarged plan view of the binder member showing the dual yarn plain knit structure.
Figure 11:
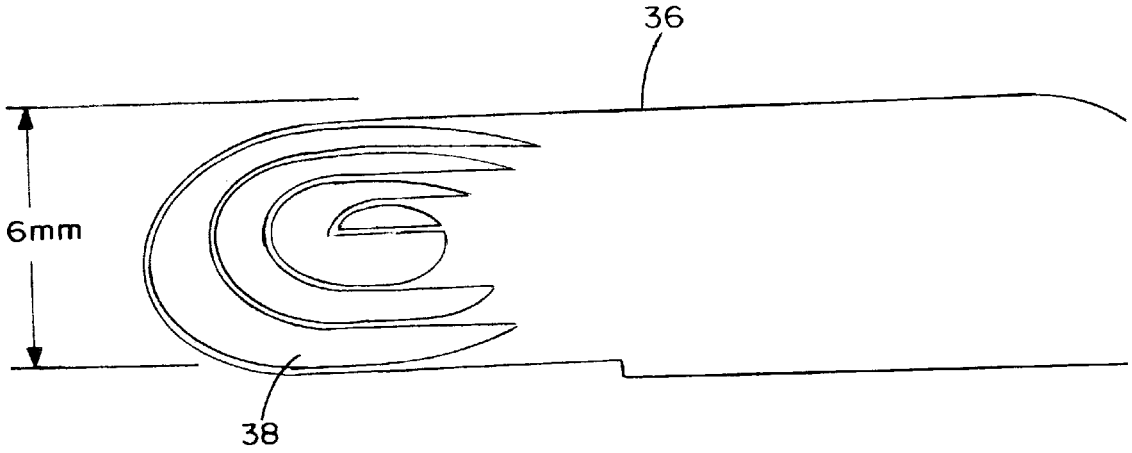
FIG. 11 is a schematic perspective view of the binder member in the rolled condition.
Figure 10:
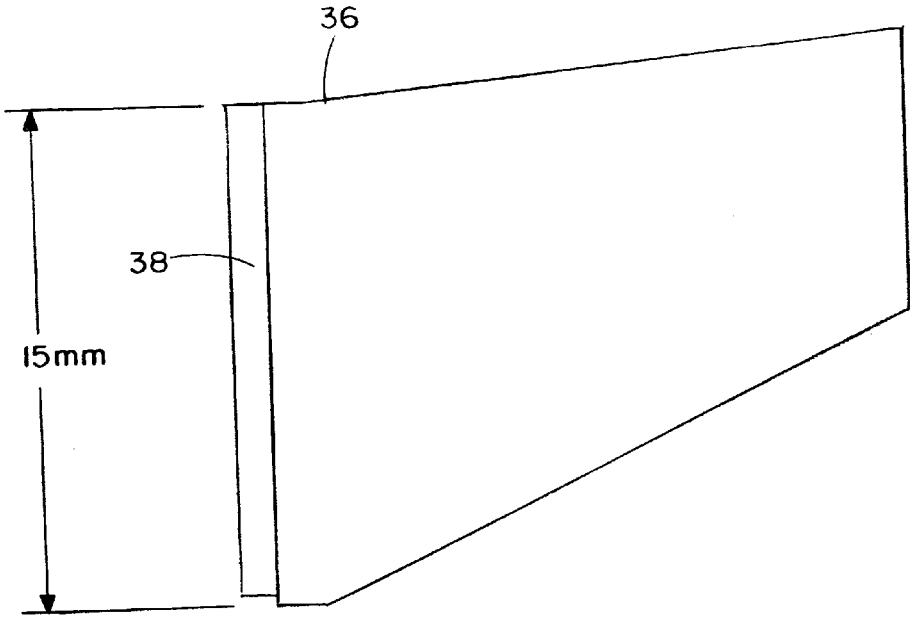
FIG. 10 is a schematic perspective view of the binder member in the unrolled condition.

The final binder portion 16 is made from polyester and nylon covered spandex yarns which continues for about 20 to 30 courses, usually resulting in a band 33 of about 3 centimeters in length, and knitted under proper tensions and stitch quality maintenance such that the section rolls back (outwardly) on itself (FIG. 3) to create rollback 25 creating a comfortable yet secure top band which has the dual effect of holding the arm warmer in place while allowing the wearer to easily begin rolling the garment down towards the wrist when the temperature warrants removal of the garment.

The top band or roll binder 34 is formed by knitting with yarn 36 selected from within a range of 200 to 220 denier spandex double covered with from 60 to 80 denier black polyester and yarn 38 selected from within a range of from 30 to 50 denier spandex covered with two ends of from 60 to 80 denier black nylon in a plaited flat-knit fashion. Yarn 36, the stronger and larger denier, is knitted on the inside of binder 34, and yarn 36, the weaker and smaller denier, is knitted to the outside of the fabric. With this unbalanced fabric construction, binder portion 34 is created and controlled by varying the courses of the yarns. Depending upon the number of courses, binder 34 rolls upon and stops itself at a pre-determined location established by the number of courses, situates itself between the bicep and tricep and shoulder muscle of the wearer, and resists further rolldown. Rolldown changes the inner circumference 37 of binder 34 and, thus, through exerted force distribution, establishes the location where the binder stays in place. The number of courses changes inner circumference 37 and thereby establishes the precise location of binder rollback 25 on the arm of the wearer. Because of the yarn structure and the number of courses utilized, resistance to further rolldown is precisely established, and additional rolldown can only be accomplished manually thereafter.

Tubular member 10 in the present invention is seamless because it is continuously and circularly knitted. There are no sewing operations involved and no reciprocation to provide additional fabric in certain sections of the garment. The increase in diameter (at four locations) of the garment is achieved solely through graduated stitches wherein the stitch lengths are increased, thereby increasing the diameter of the tubular member formed.

The method of integrally knitting the arm warmer comprising the present invention includes the steps of forming the continuously circularly knitted tubular member 10 by knitting first a conventional welt forming a wrist cuff 12, preferably of the yarns previously described, thereafter integrally knitting an arm portion 14 to wrist cuff 12 using yarns as previously described, and thereafter integrally knitting a binder portion 16 in the manner described to form a knitted fabric structure that will enable the binder portion to roll back outwardly on itself and thus create a comfortable, yet secure band to hold the arm warmer in place while allowing the wearer to easily begin rolling the garment toward the wrist when the temperature warrants removal of the garment. Varying colors of yarns can be interchanged within the wrist cuff to form distinctive colored bands, logos or other symbols designating team colors or team logos. Obviously, other decorative features can be programmed to be knitted within the wrist cuff 12 as desired. Also varying colors and/or designs can be incorporated in arm portion 14.

In using tubular member 10 forming the arm warmer of the present invention, the wearer slips member 10 over his or her arm so that it engages the wrist, forearm and onto the bicep. Binder portion 16 extends slightly above the bicep (FIG. 3) and rolls back outwardly on itself, thus creating a comfortably, yet secure and efficient binder rollback 25. The decorative wrist cuff encircles the wrist of the wearer and bears the meaningful colors or logos of the user.

From the foregoing, it will be seen that this invention is well-adapted to attain the objects desired and will provide other advantages which are obvious and are inherent to the structure. As many embodiments may be made of the invention without departing from the scope thereof, it is to be understood that all matters herein set forth or shown in the accompanying drawings are illustrative and not in a limiting sense.

What is claimed is:

1. A knitted arm warmer for covering a arm of a wearer from the wrist and onto the natural crevice of the arm where the shoulder joins the bicep and above the bicep, the arm warmer formed from a circularly knitted tubular fabric member, the member comprising: a wrist cuff having a first diameter; an arm portion joining the wrist cuff; and a binder portion having a second diameter joining the arm portion, the arm portion having a diameter equal to the first diameter at the wrist cuff and increasing in diameter until engaging the binder portion, the arm portion and the binder portion each having an inner wearer arm engaging surface and an outer surface, the binder portion having a plurality of plain knitted courses, each course having a first spandex covered yarn of a first denier and a second lower denier spandex covered yarn with the lower denier covered yarn being on the outer wearer arm engaging surface, the different yarns of the inner and outer wearer arm engaging surfaces causing the binder portion to roll down the arm of the wearer to reach a stable position between the bicep and shoulder muscle.

2. The arm warmer as claimed in claim 1 wherein the wrist cuff is a welt construction having one or more fabric layers.

3. The arm warmer as claimed in claim 2 wherein the binder portion is knitted to roll upon itself and fit within the natural crevice of the arm of the wearer just above the bicep and maintain the tubular member on the arm of the wearer.

4. The arm warmer as claimed in claim 3 wherein the arm portion has a tapered configuration and the tapered configuration is formed by providing a different arm portion diameter at each of more than one preselected locations.

5. The arm warmer as claimed in claim 4 wherein the wrist cuff is knitted with nylon and spandex yarns.

6. The arm warmer as claimed in claim 5 wherein the arm portion is knitted with nylon, spandex and wicking yarns.

7. The arm warmer as claimed in claim 6 wherein the binder portion is knitted with nylon, spandex, and polyester yarns.

8. The arm warmer as claimed in claim 7 wherein the wrist cuff welt construction includes a first wearer arm engaging fabric layer and a second outer fabric layer having a rib knitted construction.

9. The arm warmer as claimed in claim 8 wherein the knitted arm portion has a wicking yarn plaited to the arm portion inner surface and spandex covered nylon yarn plaited to the arm portion outer surface.

10. The arm warmer as claimed in claim 9 wherein the tubular fabric member is seamless.

11. The arm warmer as claimed in claim 10 wherein the tubular fabric member is continuously knitted.

12. The arm warmer is claimed in claim 1 wherein the first spandex covered yarn is selected from within a range of 200 to 220 denier double covered with polyester yarn selected from within a range of 60 to 80 denier, and the second spandex covered yarn selected from within a range of 30 to 50 denier double covered with 60 to 80 denier nylon yarn.

13. The arm warmer as claimed in claim 12 wherein the tubular fabric member is seamless and continuously knitted.

14. The method of making an arm warmer for covering a arm of a wearer from the wrist over the natural crevice of the arm where the forearm joins the bicep and over and above the bicep comprising the steps of: continuously and circularly knitting a tubular fabric member to form a wrist cuff having a first diameter; continuing to circularly knit a tapered arm portion; and continuing to circularly knit a binder portion having a second diameter, the tapered arm portion having a diameter beginning at the wrist cuff equal to the wrist cuff diameter and increasing in diameter until the tapered portion joins the binder portion and has a diameter equal to the binder portion diameter, the binder portion being plain knit with a plurality of plain knit courses, each course having a first spandex covered yarn of a first denier and a second lower denier spandex covered yarn with the lower denier covered yarn being on the outer wearer arm engaging surface, the different yarns of the inner and outer wearer arm engaging surfaces having different sizes and exerting different forces to cause the binder portion to roll down the arm of the wearer to reach a stable position between the bicep and shoulder muscle.

15. The method as claimed in claim 14 wherein the wrist cuff is a ribbed knit construction and is knitted with nylon and spandex yarns, the arm portion has a tapered configuration and the tapered configuration is formed by providing a different arm portion diameter at each of the more than one preselected location, the arm portion is knitted with nylon, spandex and wicking yarns, the binder portion is knitted to roll upon itself and fit within the natural crevice of the arm of the wearer just above the bicep and maintain the tubular member on the arm of the wearer, the binder portion is knitted with nylon, polyester, and spandex yarns, and the tubular fabric member is seamless.

16. The method as claimed in claim 15 wherein the position of the binder portion on the arm of the wearer is determined by the number of courses knitted in the binder portion.

17. The method as claimed in claim 16 wherein the number of courses knitted in the binder portion determines the inner circumference of the rolled binder portion.

* * * * *